US006799492B2

(12) United States Patent
Pearson

(10) Patent No.: US 6,799,492 B2
(45) Date of Patent: Oct. 5, 2004

(54) RATCHET WRENCH

(76) Inventor: Matthew Pearson, 189 Serrano Heights Dr., San Luis Obispo, CA (US) 93405

( * ) Notice: Subject to any disclaimer, the term of this patent is extended or adjusted under 35 U.S.C. 154(b) by 0 days.

(21) Appl. No.: 10/307,169

(22) Filed: Nov. 27, 2002

(65) Prior Publication Data

US 2004/0099099 A1 May 27, 2004

(51) Int. Cl.[7] ..... B25B 13/46; B25B 13/28

(52) U.S. Cl. ..... 81/58; 81/99; 81/111; 81/177.2

(58) Field of Search ..... 81/92–94, 97–99, 81/111–114, 58, 177.2, 60

(56) References Cited

U.S. PATENT DOCUMENTS

| | | | | | |
|---|---|---|---|---|---|
| 626,037 | A | * | 5/1899 | Rhinelander | 81/111 |
| 676,318 | A | * | 6/1901 | Jackson | 81/99 |
| ,878,388 | A | | 2/1908 | Heiman | |
| 1,251,347 | A | * | 12/1917 | Davis | 81/111 |
| 1,412,702 | A | * | 4/1922 | Nightlinger, Sr. | 81/98 |
| 1,446,619 | A | * | 2/1923 | Edwards | 81/94 |
| 1,904,903 | A | * | 4/1933 | Sweet | 81/111 |
| 2,527,033 | A | | 10/1950 | Rodgers | 81/61 |
| 2,758,493 | A | | 8/1956 | Goldwater | 81/58.2 |
| 2,953,050 | A | * | 9/1960 | Mildred | 81/99 |
| 2,954,715 | A | | 10/1960 | Wycech | 81/58.1 |
| 4,596,167 | A | * | 6/1986 | White, Jr. | 81/177.2 |
| 4,748,874 | A | * | 6/1988 | Sharp et al. | 81/177.2 |
| 4,811,638 | A | * | 3/1989 | Kertzscher | 81/177.2 |
| 4,967,612 | A | * | 11/1990 | Sparling | 81/111 |
| 5,113,726 | A | | 5/1992 | Ethridge | 81/60 |
| 5,131,300 | A | * | 7/1992 | Daniel | 81/111 |
| 5,251,518 | A | | 10/1993 | Woo | 81/99 |
| 5,927,159 | A | | 7/1999 | Yokoyama et al. | 81/99 |
| 5,996,445 | A | | 12/1999 | Wiens et al. | 81/111 |
| 6,016,723 | A | | 1/2000 | Hillinger | 81/63.1 |
| 6,263,765 | B1 | | 7/2001 | McCamley | 81/58 |
| 6,279,427 | B1 | | 8/2001 | Francis | 81/57.39 |

* cited by examiner

*Primary Examiner*—Debra S. Meislin
(74) *Attorney, Agent, or Firm*—Law Office of Philip A. Steiner

(57) ABSTRACT

A ratchet wrench for turning threaded fasteners, particularly fasteners threaded on a stud or pipe located in areas of limited or obstructed access to the fastener. The wrench is operated remotely at an end of the wrench away from a fastener engagement portion. The wrench includes a side mounted actuator assembly which allows a moveable jaw to open and close around the fastener. A closing bias force is maintained on the movable upper jaw by a spring included in the actuator assembly. The closing bias force allows a fastener to be held in position for rotation and when exceeded, allows the movable upper jaw to ratchet around the fastener. The engagement portion of the wrench may be configured with either a hexagonal or dodecahedral shaped opening. When operatively engaged with the fastener, the wrench fully encompasses the fastener to limit slippage.

5 Claims, 3 Drawing Sheets

RATCHET WRENCH

FIELD OF INVENTION

The invention relates to a ratchet wrench for rotating threaded fasteners and in particular threaded fasteners located in areas having obstructions or limited access to the fastener to be rotated.

BACKGROUND

In the relevant art, various hand tools or wrenches are provided for turning of fasteners such as threaded nuts, bolts or pipes. In particular, those wrenches associated with turning a nut or bolt generally rely on a hexagonal shaped head and may be characterized as an open-end wrench which generally engages the fastener on two parallel surfaces of the hexagon head, or a closed-end wrench which engages the fastener on all six corners of the hexagon. The closed-end wrench may have either a hexagonal or dodecahedral configuration. The hexagonal configuration has the advantages of being the same hexagonal shape as the fastener which provides the greatest contact surface areas for transferring rotational forces from the wrench to the fastener, thus reducing the likelihood of slippage from the fastener. However, the hexagonal configuration limits the available engagement geometries with the fastener which is particularly troublesome when attempting to rotate a fastener in a tight or obstructed location. A dodecahedral configuration provides twelve angled surfaces for engagement with the fastener, thus improving the available engagement geometries but reduces the contact surface areas with the fastener allowing for more likelihood of slippage from the fastener.

A further characteristic of the open-end wrench is that it may engage the fastener from either the side or top. However, the closed-end wrench must engage the fastener from the top. If the fastener is on a long continuous shaft, such as a long bolt, stud, or a length of threaded pipe, access to the top of the fastener is restricted and the closed-end wrench may be unable to engage the fastener, or in the alternative, engaging the fastener may involve moving the wrench such a distance along the stud or pipe as to make its use impractical. In these cases, the open-end wrench has an advantage in accessing the fastener. The open-end wrench however has the disadvantage of limited engagement of the fastener, and due to varying tolerances in fastener size, it is known for open-end wrenches to damage the corners of the hexagon, and perhaps cause injury to the wrench user, by "slipping," especially if the fastener is difficult to turn.

A variation of the closed-end wrench, commonly called a flare nut wrench, is essentially a closed-end wrench with a small opening in the end that allows slipping the wrench over tubing or a threaded stud to engage the fastener. Due to the opening, these wrenches can slip and cause damage to the fastener or injure the wrench user. In addition, flare nut wrenches require clearances around the fastener to allow for positioning of the wrench with the fastener which limits the usefulness of the flare nut wrench in tight or obstructed locations.

Several inventions have attempted to combine the complete fastener engagement advantages of the closed-end wrench with the side engagement advantages of the open-end wrench. U.S. Pat. No. 2,758,493 (Goldwater) teaches a reversible ratchet wrench that engages a fastener on the side and provides a six point engagement of the fastener.

U.S. Pat. No. 5,113,726 (Ethridge) teaches a pipe fastener tool that also provides a side six point fastener engagement.

U.S. Pat. No. 6,263,765 (McCamley) shows another wrench capable of side six point fastener engagement. U.S. Pat. No. 6,279,427 (Francis) shows a hydraulically operated torque wrench designed for side twelve point fastener engagement.

Each of these inventions provides a solution to turning a fastener on a continuous shaft that is useful in some applications. However, all of these inventions require manipulation of the head of the wrench mechanism at a location in proximity to the fastener, and therefore cannot be used in situations where access to the fastener is so restricted that the fastener is not readily accessible to the hands of the user.

Therefore, what is highly desirable is a simple tool whose actuator assembly is operated remotely from the fastener in situations where access to the fastener on a continuous stud, bolt or pipe is restricted and further includes a narrow profile so that it may be used in tight or obstructed locations.

SUMMARY

Objects and Advantages

One object of this invention is to provide a tool to turn a fastener that engages fasteners that are on a threaded stud or pipe.

A second object of this invention is to provide a tool to turn a fastener that provides either a six or twelve point engagement of the fastener.

A third object of this invention is to provide a tool to turn a fastener that engages a fastener in a restricted access location where the fastener cannot be reached by the user's hands.

A fourth object of this invention is to provide a tool to turn a fastener that will access the fastener in a confined space of approximately the width of the fastener.

A fifth object of this invention is to provide a tool to turn a fastener that is adaptable to a variety of turning aids.

A sixth object of this invention is to provide a tool to turn a fastener that is sturdily and simply constructed so as to provide long tool life.

A seventh object of this invention is to provide a tool to turn a fastener that is economical to manufacture.

The invention comprises a ratchet wrench for turning a fastener in a tight or obstructed location. The wrench is manufactured to have a narrow profile equal to or less than that of a fastener in which the wrench is intended to be used upon. The narrow profile allows the wrench to be used in locations having restricted access or obstructions. The thickness of the body of the wrench in relation to either the body's width or length defines the narrow profile. The thickness of the body is such that it is considerably smaller than either the width or length which allows the body of the wrench to fit in tight or obstructed locations.

The wrench includes a fixed jaw which is incorporated into a front end of a body of the wrench. Another movable upper jaw is pivotally attached to the body of the wrench and is further coupled to an actuator assembly. The actuator assembly is operable from a position away from the movable and fixed jaws. The movable and fixed jaws are arranged in opposition and define between themselves a substantially equal regular polygon shaped opening for engaging the fastener. The regular polygon shaped opening may be in the form of a hexagon or dodecahedron. The body of the wrench includes a receptacle for attaching a handle such as a breaker bar, standard ratchet wrench or extension bar. In one embodiment of the invention, the handle is attached perpendicular to the body of the wrench. In another embodiment of the invention the handle is attached in parallel to the body of the wrench.

In both embodiments of the invention, the drive receptacle is situated along a longitudinal center axis of the body of the wrench.

The wrench includes an opening side for situating the fastener between the movable and fixed jaws which is approximately centered along one side of the regular polygon shaped opening. A pivoting side is provided for attaching the movable upper jaw to the wrench body and is positioned on the opposite side of the regular polygon shaped opening in parallel to the opening side. The movable upper jaw is pivotally attached to the body of the wrench with a fastener means such as a pin, rivet, or bolt.

An actuator assembly is provided for operating the wrench remotely, away from the movable and fixed jaws and includes a guide extending laterally from the pivoting side for slideably maintaining the actuator shaft adjacent to and generally in parallel with the pivoting side. A second pivotal fastener is provided for pivotally fastening the actuator shaft to the movable upper jaw. The actuator shaft is pivotally attached to the movable upper jaw with a fastener means such as a pin, rivet, or bolt.

The actuator shaft provides the means for slideably transmitting an opening and a closing force to the movable upper jaw during operation. A coil or torsion spring coupled to the actuator shaft is used to provide a closing bias force to the movable upper jaw. The closing force bias may be adjusted by moving a spring stop longitudinally along the actuator shaft in order to obtain a desired closing bias force. The closing bias force is intended to provide sufficient force to allow an user to tighten a fastener until snug against another surface. If the closing bias force is exceeded, the movable upper jaw is allowed to perform a ratcheting action.

DETAILED DESCRIPTION

Various embodiments of the ratchet wrench invention are shown in FIGS. 1 through 7. The invention includes a means of fastener engagement and turning in a tight or obstructed location. This capability is useful where the fastener is threaded on a stud, pipe or bolt that either continues beyond the area of access or is located between interfering structures.

The wrench engages and turns fasteners with restricted access, even when the fastener location is not accessible to a user's hands.

Figure 1:
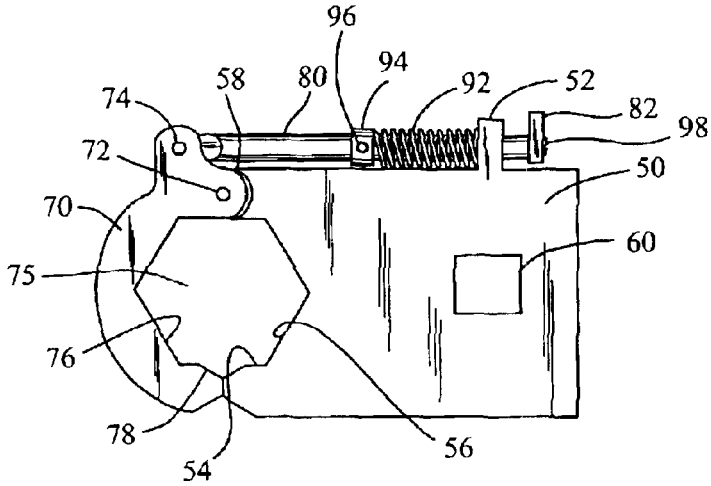
FIG. 1—is a top view of the invention illustrating a first embodiment.

FIG. 1 depicts a top view of the assembled wrench which comprises a movable upper jaw 70 having an upper engagement surface 76 and an upper clearance surface 78. The movable upper jaw 70 is attached to a body 50 of the wrench at a first pivot point 72 and to an actuator shaft 80 at a second pivot point 74. The pivot points 72, 74 each include a pivotable fastener means such as a pin, rivet or bolt and are located on a pivoting side of the body 50 of the wrench.

The body 50 of the wrench includes an opposing lower fixed jaw 56 incorporated into a front end of the body 50 of the wrench and a lower clearance surface 54 associated with the lower fixed jaw 56. The upper and lower clearance surfaces 78, 54 provides the clearance during motion of the clamp over the fastener to allow final engagement of the fastener by the wrench. The movable upper jaw 70 and lower fixed jaw 56 define substantially and evenly between themselves a hexagonal opening 75 for engaging a hexagonal fastener. When operatively engaged with a fastener the movable upper jaw 70 and lower fixed jaw 56 fully encompass the fastener.

The body 50 of the wrench further includes a drive receptacle 60 where the drive receptacle 60 for attaching a drive handle is provided along a longitudinal center axis and near a rear end of the body 50. The narrow profile allows the wrench to be used in locations having restricted access or obstructions. The thickness of the body of the wrench in relation to either the body's width or length defines the narrow profile. The thickness of the body is such that it is considerably smaller than either the width or length which allows the body of the wrench to fit in tight or obstructed locations.

A guide 52 is provided on the same side of the wrench body as the pivot points 72, 74. The guide 52 maintains the actuator shaft 80 in a generally parallel position in relation to the pivot side of the body 50 of the wrench and also serves as a fixed lower spring retention stop for a spring 92. An actuator assembly is shown and includes the actuator shaft 80 pivotally coupled to the movable upper jaw 70, the spring 92 and an upper spring retention stop 94. The spring 92 is coaxially placed over the actuator shaft 80 and rests against one side of the guide 52. The upper spring retention stop 94 is used to maintain the spring 92 in a somewhat compressed position to provide a closing bias force on the movable upper jaw 70 and includes a fastener 96 such as a bolt, pin or setscrew, to lock the upper spring retention stop 96 into a position along the actuator shaft 80. The closing bias force may be varied by adjustment of the upper spring retention stop 94 as needed to provide the desired closing force on the movable upper jaw 70. A lever 82 is provided on a lower end of the actuator shaft 80 to allow a user to open and close the movable upper jaw. The lever 82 is attached to the lower end of the actuator shaft 80 by way of a lever fastener 98 such as a bolt, pin or setscrew. The actuator assembly is remotely operated from the pivoting side by applying force to the lever 82.

Figure 1A:
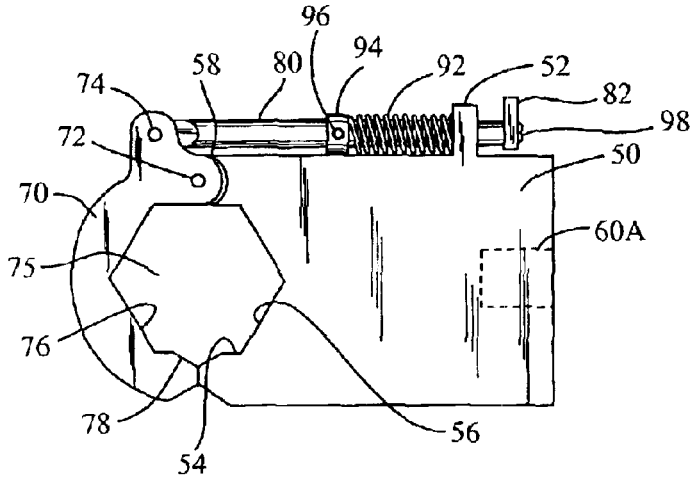
FIG. 1A—is a second top view of the invention illustrating a second embodiment.

Referring to FIG. 1A, an alternate embodiment of the invention is shown where the drive receptacle 60A for attaching the drive handle is provided along the longitudinal center axis and at a rear end of the body 50 of the wrench. In this embodiment of the invention, the handle is attached in parallel to the longitudinal center axis of the body 50 of the wrench.

Figure 1B:
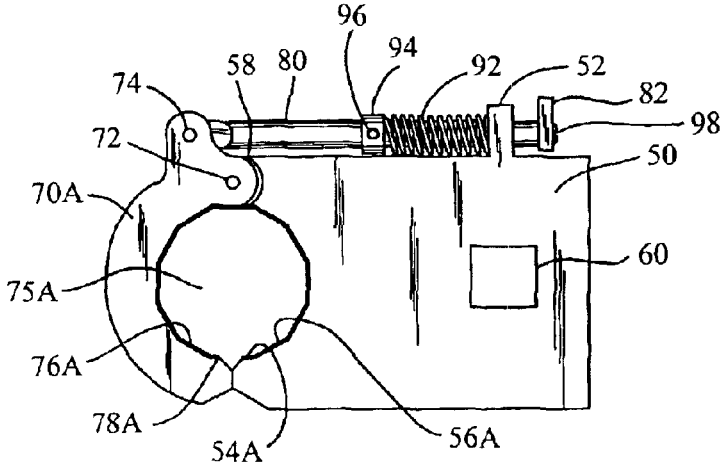
FIG. 1B—is a third top view of the invention illustrating a third embodiment.

Referring to FIG. 1B, another embodiment of the invention is shown where the movable upper jaw 70A, upper engagement surface 76A, upper clearance surface 78A., lower clearance surface 54A and lower fixed jaw 56A define substantially evenly between themselves a dodecahedral opening 75A for engaging a hexagonal fastener. The dodecahedral arrangement improves the available engagement geometries when using the wrench in a limited or obstructed location.

Figure 2:
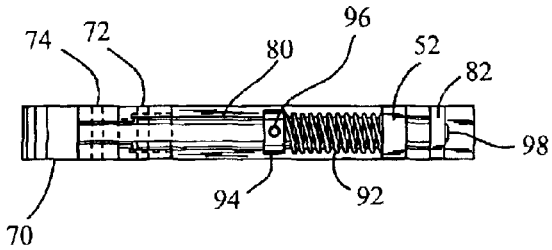
FIG. 2—is a first side view of the invention.

In FIG. 2, a side view of the invention depicting the relative position of the actuator assembly 80, 92, 94, 96, 98 on the pivoting side 72, 74 of the body 50 of the wrench. The wrench has a narrow profile which allows its use in locations having limited clearances, obstructions and/or interfering surfaces. The narrow profile is sized to be less than or equal to the size of fastener. It is envisioned by the inventor that several different sized profiles and/or fasteners will be manufactured. In one embodiment of the invention, the wrench is constructed from a tool grade steel. In another embodiment of the invention, the wrench is constructed from a high impact plastic.

Figure 3:
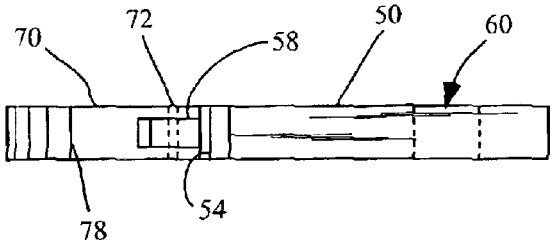
FIG. 3—is a second side view of the invention with a movable upper jaw in an open position.

In FIG. 3, another side view of the invention which depicts the movable upper jaw 70 in an open position is shown when viewed from the opening side of the body 50 of the wrench. The upper and lower clearance surfaces 78, 54 are depicted along with the pivot point 72 in which the movable upper jaw 70 is attached with the fastener to the body 50 of the wrench. The movable upper jaw 70 fits over a narrowed extension 58 of the wrench body 50 which allows for a uniform dimension of the wrench in the narrow profile plane. The drive receptacle 60 is provided for attaching a handle to the body 50 of the wrench.

Figure 4:
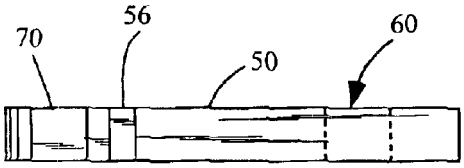
FIG. 4—is the second side view of the invention with the movable upper jaw in a closed position.

In FIG. 4, a third side view of the invention which depicts the movable upper jaw 70 in a closed position is shown when viewed from the opening side of the body 50 of the wrench. The movable upper jaw 70 is shown in a closed position which contacts the lower fixed jaw 56 incorporated into the body 50 of the wrench. The movable upper jaw 70 aligns with the fixed lower fixed jaw 56 substantially in parallel with respect to each other. The drive receptacle 60 is provided for attaching a handle to the body 50 of the wrench.

Figure 5:
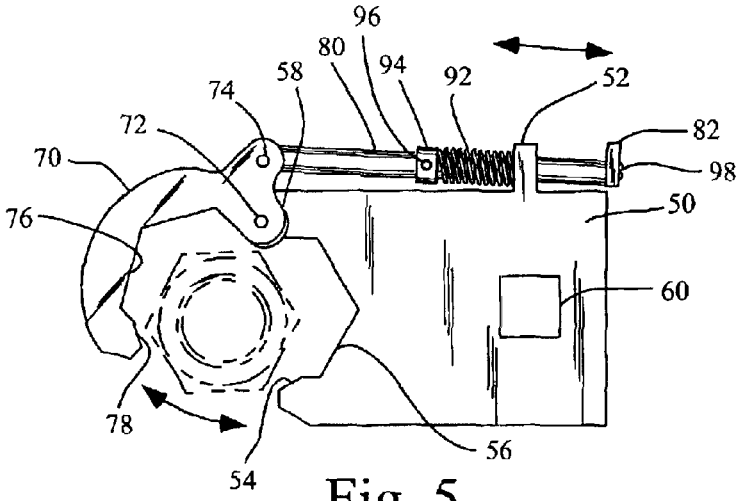
FIG. 5—is a top view of the invention shown with the movable upper jaw in an open position.

Referring to FIG. 5, the movable upper jaw 70 can be moved to an open position by sliding the actuator shaft 80 in a direction directly opposite from the movable upper jaw 70. Likewise, the movable upper jaw 70 can be moved to a closed position by sliding the actuator shaft 80 in the direction directly toward the movable upper jaw. Moving the actuator shaft 80 toward the open position also compresses the spring 92. The spring 92 is sized to maintain a closing bias force on the movable upper jaw 70 even when the movable upper jaw 70 is in the fully closed position. The closing bias force maintains engagement of the movable upper jaw 70 with the fastener. Exceeding of the closing bias force, allows the movable upper jaw 70 to provide a ratcheting action. The drive receptacle 60 is provided for attaching a handle to the body 50 of the wrench.

Figure 6:
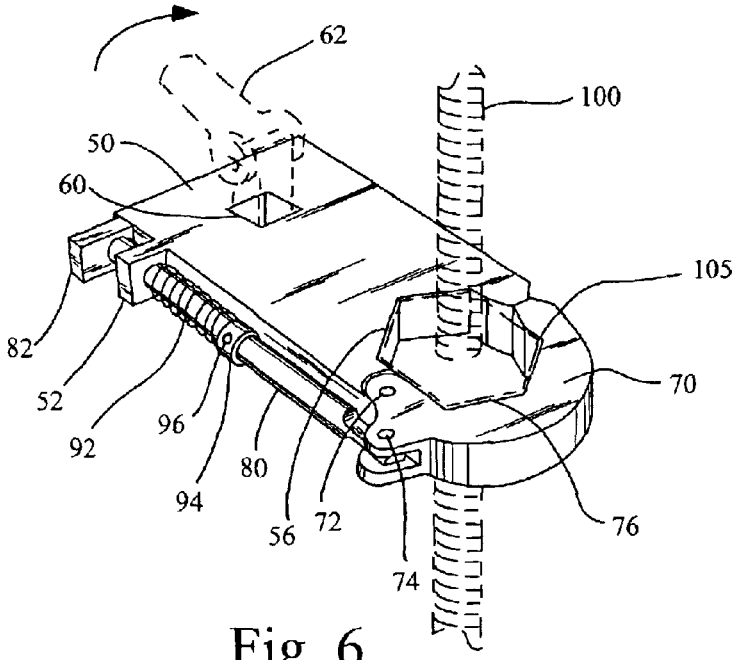
FIG. 6—is a perspective view of the invention showing the wrench engaged with a fastener installed on a vertical threaded stud.

In FIG. 6, an operation of the invention is shown where the wrench is used to turn a fastener 105 installed on a threaded stud 100. The operation begins with selecting a wrench to match the size fastener to be turned. The selected wrench is placed in the open position by holding the body 50 of the wrench and applying a opening force on the actuator shaft 80 using the lever 82. The opening force causes the movable upper jaw to rotate in the opening direction. The wrench is then placed in the position shown in FIG. 5, where the movable upper jaw 70 is opened sufficiently to allow placement of the upper and lower engagement surfaces 56, 76 around the fastener.

The wrench is oriented around the fastener such that the desired direction of rotation of the fastener will be towards the opening side as shown in FIG. 6. The movable upper jaw 70 is then closed around the fastener by either applying a pushing force to the actuator shaft 80 or allowing the closing bias force provided by the spring 92 to position the movable upper jaw around the fastener. This movement will place the wrench approximately in the position shown in FIG. 6. The wrench may now be rotated by placing a drive handle 62 in the drive receptacle 60 and applying force in the direction shown in FIG. 6.

Figure 7:
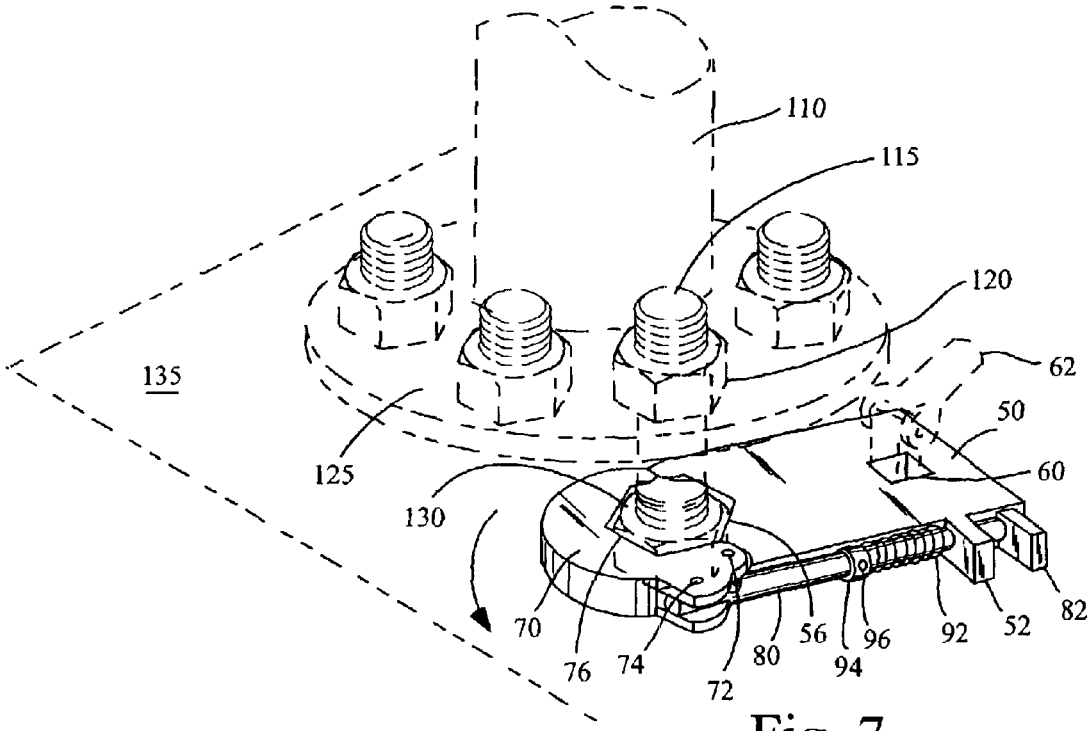
FIG. 7—is another perspective view of the invention showing the wrench engaged with a fastener between interfering objects.

In FIG. 7, another operation of the invention is shown where the wrench is used to turn a fastener 130 installed between interfering surfaces 125, 135. The narrow profile of the wrench allows access to the fastener 130 installed on a bolt 115. The remote actuator assembly 80, 82, 92 94, 98 allows positioning of the wrench to engage and tighten the fastener 130 until snug against the opposing surface 125 of the flange. The closing bias force provided by the spring 92 on the movable upper jaw 70, provides a ratcheting action of the movable upper jaw 70 in the tight space available between the interfering surfaces 125, 130, allowing turning of the fastener. The final torque to hold the vertical pipe 115 is applied to an upper fastener 120. As described above, the wrench is rotated by placing a drive handle 62 in the drive receptacle 60 and applying force in the direction shown in FIG. 7.

The foregoing described embodiments of the invention are provided as illustrations and descriptions. They are not intended to limit the invention to precise form described. Other variations and embodiments are possible in light of above teachings, and it is not intended that this Detailed Description limit the scope of invention, but rather by the claims following herein.

What is claimed:

1. A ratchet wrench for turning a fastener comprising:

a body of the wrench including a lower fixed jaw incorporated into a substantial portion of a front end of said body;

a movable upper jaw pivotally attached to a corner of said front end and arranged in opposition to said lower fixed jaw such that said movable upper jaw and said lower fixed jaw define substantially therebetween, a regular polygon shaped opening for engaging and fully encompassing said fastener;

an actuator assembly means for transmitting opening and closing forces to said movable upper jaw, wherein said actuator assembly means includes an actuator shaft slidably mounted to a side of said body; and a guide extending laterally from said side and adjacent to said corner for slideably maintaining said actuator shaft adjacent to and generally in parallel with said side;

said actuator shaft pivotally coupled to said movable upper jaw for slideably transmitting an opening and a closing force to said movable upper jaw; and, a spring means coupled to said actuator shaft for generating a closing bias force such that said movable upper jaw is maintained in a closed position until said closing bias force is exceeded.

2. The ratchet wrench according to claim 1, in which said spring means includes means for adjusting said closing bias force.

3. A ratchet wrench for turning a fastener comprising:

a body of the wrench including;

a lower fixed jaw incorporated into a substantial portion of a front end of said body, a pivoting side for pivotally attaching a movable upper jaw to said body, and a drive receptacle for attaching a handle;

said movable upper jaw arranged in opposition to said lower fixed jaw such that said movable upper jaw and said lower fixed jaw define therebetween, a regular hexagonal shaped opening for engaging and fully encompassing said fastener; and an actuator assembly including;

an actuator shaft pivotally coupled to said movable upper jaw for slideably transmitting an opening and a closing force to said movable upper jaw, a guide extending laterally from said pivoting side for maintaining said actuator shaft adjacent to and generally in parallel with said pivoting side, and a spring means coupled to said actuator shaft for generating a closing bias force only sufficient to maintain said movable upper jaw in a closed position when tightening a fastener until snug against an opposing surface.

4. The ratchet wrench according to claim 3 wherein exceeding said closing bias force causes said movable upper jaw to perform a ratcheting action.

5. The ratchet wrench according to claim 3 in which said spring means includes means for adjusting said closing bias force.

* * * * *